US011692428B2

(12) United States Patent
Labahn et al.

(10) Patent No.: US 11,692,428 B2
(45) Date of Patent: Jul. 4, 2023

(54) DOWNHOLE DYNAMOMETER

(71) Applicant: Halliburton Energy Services, Inc., Houston, TX (US)

(72) Inventors: Lyn Duane Labahn, Houston, TX (US); John Leslie Wisinger, Jr., Spring, TX (US); Bradley David Dunbar, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 179 days.

(21) Appl. No.: 16/983,852

(22) Filed: Aug. 3, 2020

(65) Prior Publication Data

US 2021/0148216 A1 May 20, 2021

Related U.S. Application Data

(60) Provisional application No. 62/937,503, filed on Nov. 19, 2019.

(51) Int. Cl.

| | |
|---|---|
| ***E21B 47/007*** | (2012.01) |
| ***E21B 44/06*** | (2006.01) |
| ***E21B 47/008*** | (2012.01) |
| ***E21B 44/04*** | (2006.01) |
| ***E21B 47/18*** | (2012.01) |
| ***E21B 47/06*** | (2012.01) |

(52) U.S. Cl.

CPC ..... *E21B 44/06* (2013.01); *E21B 44/04* (2013.01); *E21B 47/007* (2020.05); *E21B 47/008* (2020.05); *E21B 47/06* (2013.01); *E21B 47/18* (2013.01)

(58) Field of Classification Search

CPC ..... E21B 44/00; E21B 44/04; E21B 44/06; E21B 47/007; E21B 47/008

See application file for complete search history.

(56) References Cited

U.S. PATENT DOCUMENTS 5,842,149 A * 11/1998 Harrell ..... E21B 47/00 702/9
6,547,016 B2 * 4/2003 Wassell ..... E21B 47/007 175/45
6,957,575 B2 * 10/2005 Boucher ..... E21B 44/00 73/152.59

(Continued)

OTHER PUBLICATIONS

Halliburton, Sperry Drilling,Sperry Drilling Services, Mud Motor Product Line (SperryDrill, StrataForce) 2017.

*Primary Examiner* — D. Andrews
(74) *Attorney, Agent, or Firm* — Michael Jenney; C. Tumey Law Group PLLC

(57) ABSTRACT

A method for using a mud motor may comprise drilling a borehole into a formation using a drill string connected to the mud motor and the mud motor is connected to a drill bit, measuring one or more parameters of the mud motor in the borehole, and sending the one or more parameters to surface. A system may comprise a mud motor connected to a drill string, a drill bit connected to the mud motor, a strain gauge, and in information handling system. The strain gauge may be connected to the drill bit and configured to take one or more parameters of the mud motor. The information handling system may be in communication with the strain gauge and configured to record the one or more parameters from the strain gauge.

22 Claims, 9 Drawing Sheets

(56) References Cited

U.S. PATENT DOCUMENTS

| | | | | |
|---|---|---|---|---|
| 2010/0319992 | A1* | 12/2010 | Trinh | E21B 44/005 702/9 |
| 2013/0277112 | A1* | 10/2013 | Edbury | E21B 21/01 175/27 |
| 2015/0083492 | A1* | 3/2015 | Wassell | E21B 44/00 175/24 |
| 2015/0252664 | A1* | 9/2015 | Astrid | G05B 13/021 700/275 |
| 2018/0010396 | A1 | 1/2018 | Dunbar et al. | |
| 2018/0030786 | A1 | 2/2018 | Dunbar et al. | |
| 2018/0045003 | A1 | 2/2018 | Evans et al. | |
| 2018/0066513 | A1* | 3/2018 | Sugiura | E21B 7/06 |
| 2018/0135402 | A1* | 5/2018 | Jeffryes | E21B 44/06 |
| 2018/0163480 | A1 | 6/2018 | Evans et al. | |
| 2018/0195348 | A1 | 7/2018 | Lange et al. | |
| 2018/0283161 | A1* | 10/2018 | Bailey | E21B 45/00 |
| 2020/0165876 | A1 | 5/2020 | Dunbar | |

* cited by examiner

DOWNHOLE DYNAMOMETER

CROSS-REFERENCE TO RELATED APPLICATION

The present application claims the benefit of U.S. Provisional Application No. 62/937,503, entitled "DOWNHOLE DYNAMOMETER" and filed Nov. 19, 2019, the disclosure of which is incorporated herein by reference for all purposes.

BACKGROUND

Wells may be drilled into subterranean formations to recover natural deposits of hydrocarbons and other desirable materials trapped in geological formations in the Earth's crust. Wells may be drilled by rotating a drill bit which may be located on a bottom hole assembly at a distal end of a drill string. During drilling operations, a mud motor may rotate the drill bit, which may then drill through a formation. Mud motors are utilized in oil and gas drilling to directionally steer the wellbore and deliver additional energy to the drill bit to improve drilling performance. The manufacturing of mud motors may be specific to perceived environments the drill bit may encounter in the formation.

However, performance of the mud motor may not be known until actual drilling operations. This is because current methods of testing the mud motor before use are often expensive, time consuming, and may not correctly replicate downhole conditions or drilling fluid properties.

BRIEF DESCRIPTION OF THE DRAWINGS

These drawings illustrate certain aspects of some examples of the present disclosure and should not be used to limit or define the disclosure.

DETAILED DESCRIPTION

This disclosure may generally relate to methods for determining mud motor characteristics from downhole and surface measurements. More particularly, examples may relate to methods for utilizing downhole measurements and surface measurements to determine one or more characteristics of a mud motor. The characteristics may be used to alter the mud motor or design improved mud motors.

Figure 1:
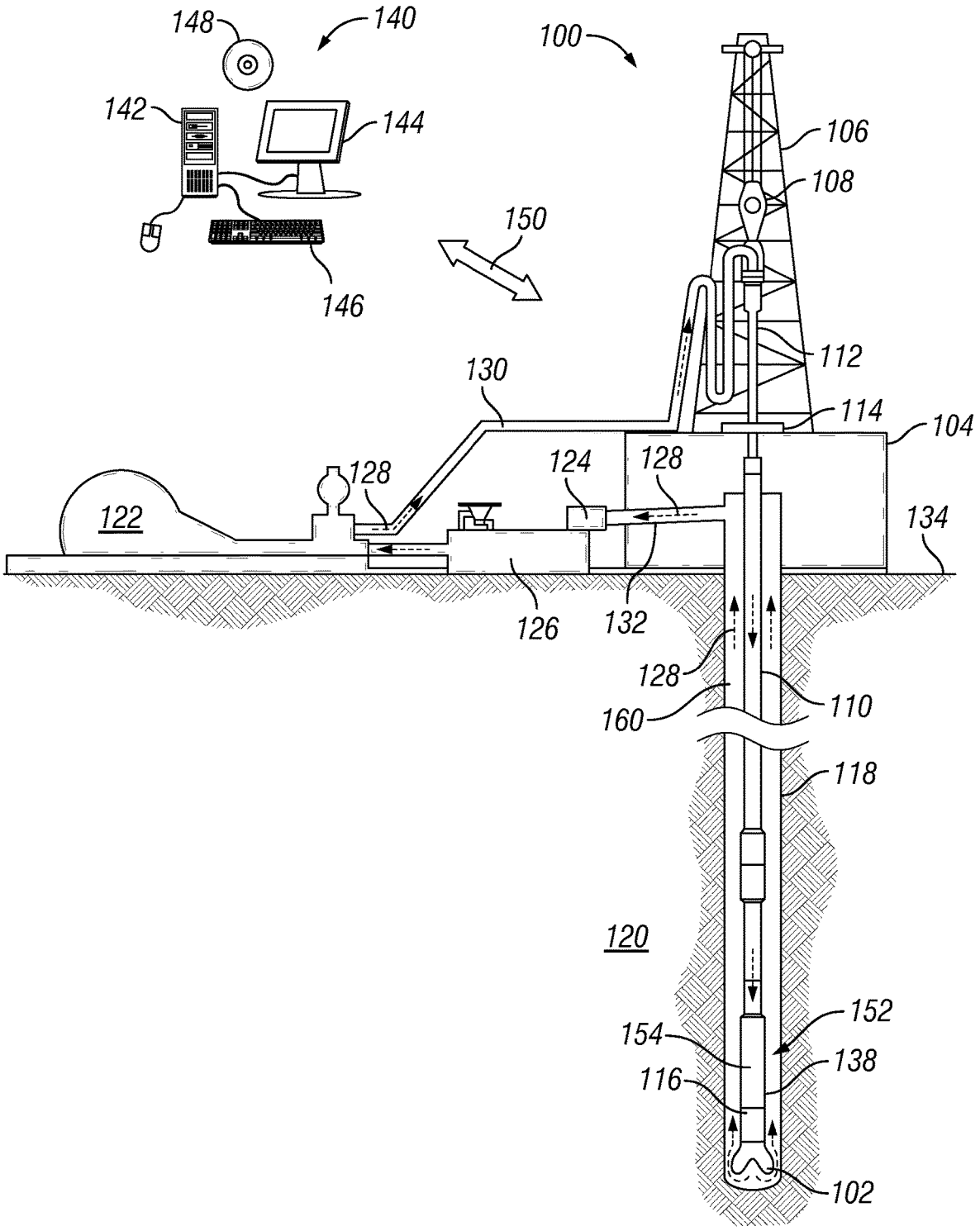
FIG. 1 illustrates an example of a drilling system.

FIG. 1 illustrates a drilling system 100 that may include a drill bit 102. It should be noted that while FIG. 1 generally depicts drilling system 100 in the form of a land-based system, those skilled in the art will readily recognize that the principles described herein are equally applicable to subsea drilling operations that employ floating or sea-based platforms and rigs, without departing from the scope of the disclosure.

Drilling system 100 may include a drilling platform 104 that supports a derrick 106 having a traveling block 108 for raising and lowering a drill string 110. A kelly 112 may support drill string 110 as drill string 110 may be lowered through a rotary table 114. Drill bit 102 may include a drill bit 102 attached to the distal end of drill string 110 and may be driven either by a downhole mud motor 116, discussed below, and/or via rotation of drill string 110. Without limitation, drill bit 102 may include any suitable type of drill bit 102, including, but not limited to, roller cone bits, fixed cutter bits, PDC bits, natural diamond bits, any hole openers, reamers, coring bits, and the like. As drill bit 102 rotates, drill bit 102 may create a borehole 118 that penetrates various formations 120.

Figure 2:
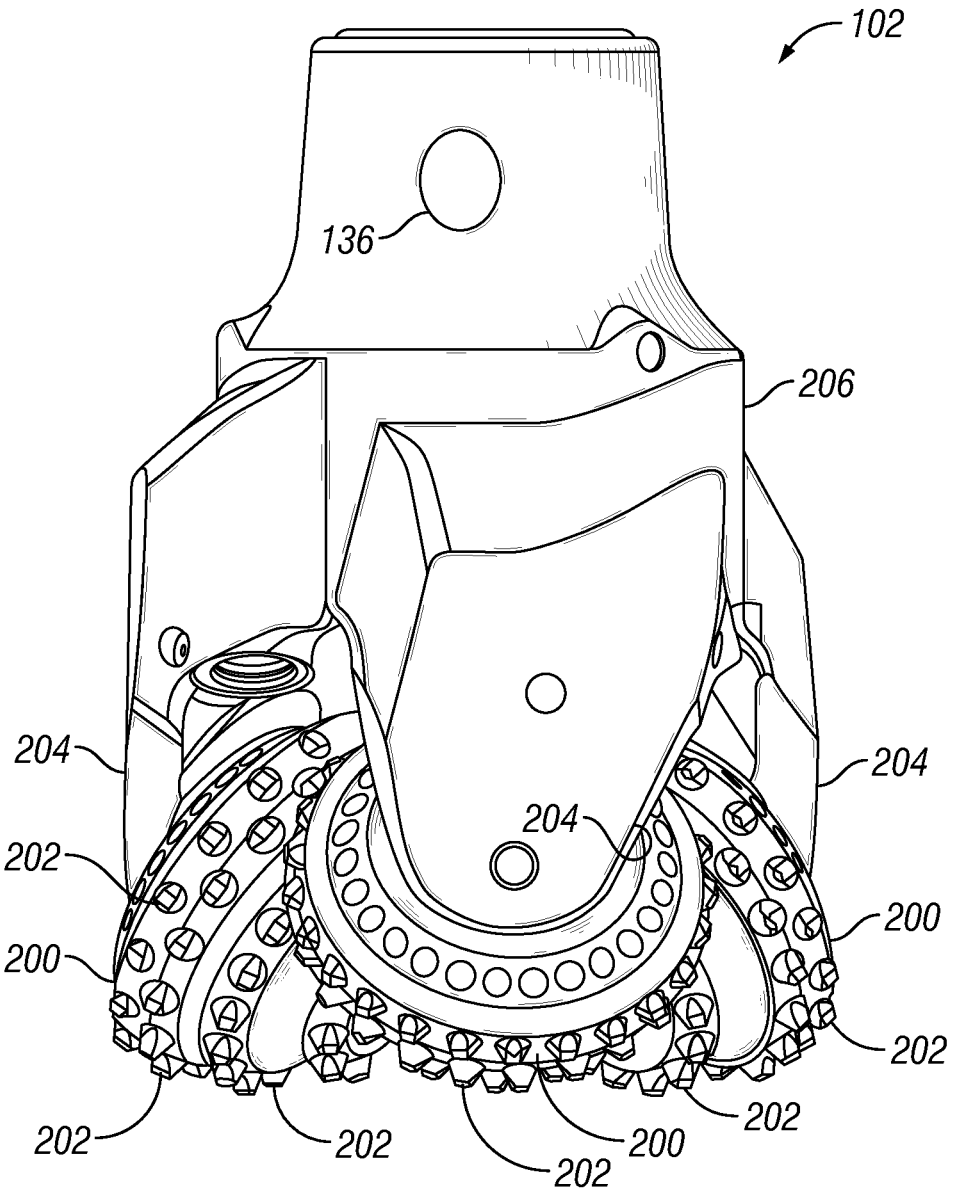
FIG. 2 illustrates an example of a drill bit.

FIG. 2 illustrates an example of drill bit 102 known as a roller cone bit (more particularly in this example, a tri-cone bit), due to its use of multiple (three in this case) generally conical-shaped rollers or cones 200 having earth-engaging cutting elements 202 thereon. Each of cone 200 is rotatably secured to a respective arm 204 extending downwardly from a main body 206 of drill bit 102. In this example, there are three cones 200 and three arms 204. However, without limitation the principles of this disclosure may be incorporated into drill bits having any other number of cones 200 and arms 204, other types of cutting structures (e.g., not necessarily cones and cutting elements) and other types of drill bits 102 and drill bit configurations. Additionally, drill bit 102 may include a strain gauge 136, further discussed below. Drill bit 102 depicted in FIG. 2 is merely one example of a wide variety of drill bits 102 which can utilize the principles described herein.

Figure 3:
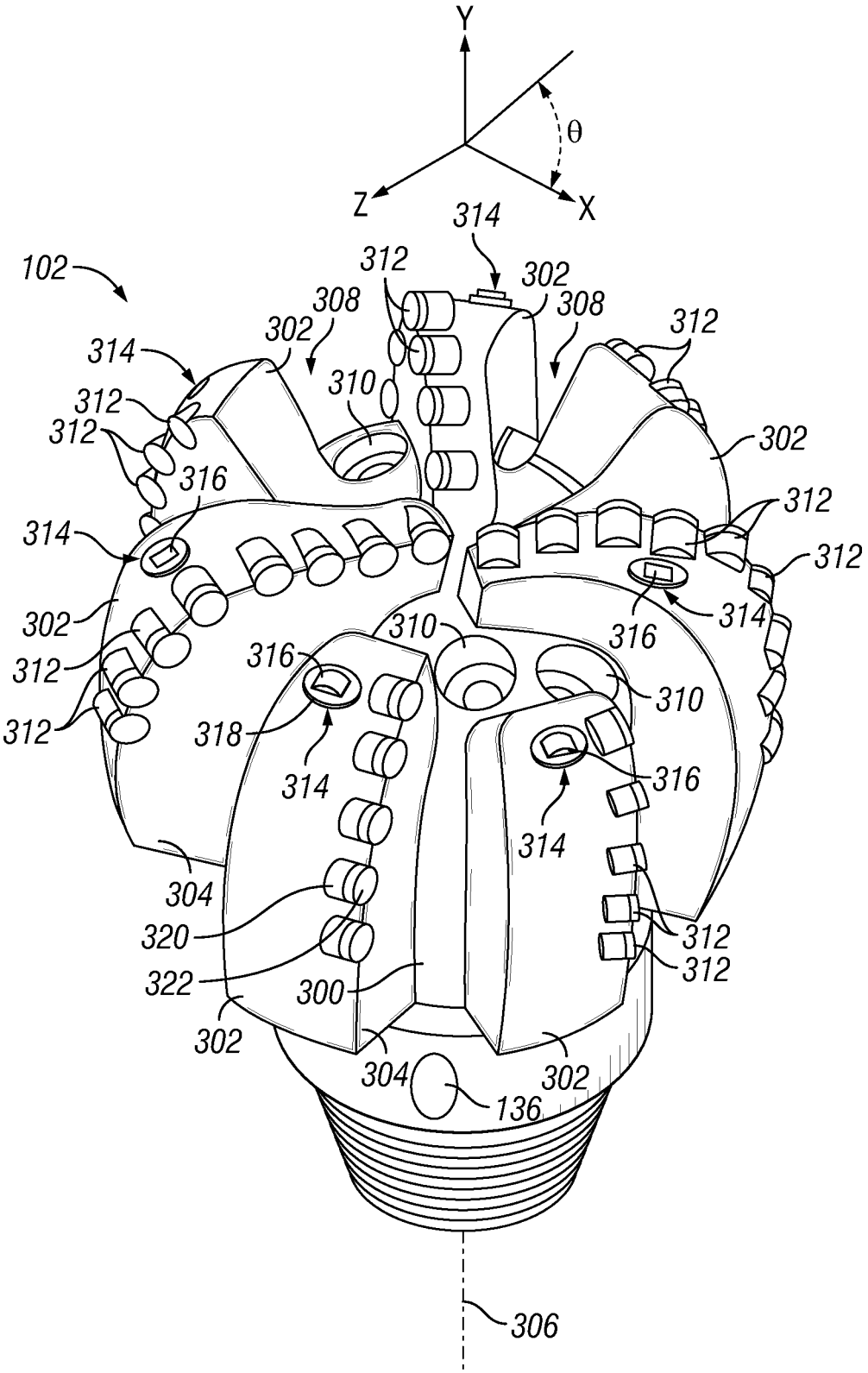
FIG. 3 illustrates another example of the drill bit.

FIG. 3 illustrates an example of drill bit 102 known as a fixed cutter bit. Without limitation, drill bit 102 may be applied to any fixed cutter drill bit category, including polycrystalline diamond compact (PDC) drill bits, sometimes referred to as drag bits, and which can be, for example, matrix drill bits and/or steel body drill bits depending on the composition and manufacture of the bit body. While drill bit 102 is depicted as a fixed cutter drill bit, the principles of the present disclosure are equally applicable to other types of drill bits operable to form a wellbore including, but not limited to, fixed cutter core bits, impregnated diamond bits and roller cone drill bits.

With continued reference to FIG. 3, drill bit 102 includes a bit body 300 of drill bit 102 which may include radially and longitudinally extending blades 302 having leading faces 304. Bit body 300 may be made of steel or a matrix of a harder material, such as tungsten carbide. Bit body 300 rotates about a longitudinal drill bit axis 306 to drill into underlying subterranean formation under an applied weight-on-bit. Corresponding junk slots 308 are defined between circumferentially adjacent blades 302, and a plurality of nozzles or ports 310 may be arranged within junk slots 308 for ejecting drilling fluid that cools drill bit 102 and otherwise flushes away cuttings and debris generated while drilling.

Bit body 300 further includes a plurality of fixed cutters 312 secured within a corresponding plurality of cutter pockets sized and shaped to receive fixed cutters 312. Each fixed cutter 312 in this example comprises a fixed cutter secured within its corresponding cutter pocket via brazing, threading, shrink-fitting, press-fitting, snap rings, or any combination thereof. Fixed cutters 312 are held in blades 302 and respective cutter pockets at predetermined angular orientations and radial locations to present fixed cutters 312 with a desired angle against the formation being penetrated. As drill bit 102 is rotated, fixed cutters 312 are driven through the formation by the combined forces of the weight-on-bit and the torque experienced at drill bit 102. During drilling, fixed cutters 312 may experience a variety of forces, such as drag forces, axial forces, reactive moment forces, or the like, due to the interaction with the underlying formation being drilled as drill bit 102 rotates.

Each fixed cutter 312 may include a generally cylindrical substrate 320 made of an extremely hard material, such as tungsten carbide, and a cutting face 322 secured to the substrate 320. The cutting face 322 may include one or more layers of an ultra-hard material, such as polycrystalline diamond, polycrystalline cubic boron nitride, impregnated diamond, etc., which generally forms a cutting edge and the working surface for each fixed cutter 312. The working surface is typically flat or planar but may also exhibit a curved exposed surface that meets the side surface at a cuffing edge.

Generally, each fixed cutter 312 may be manufactured using tungsten carbide as the substrate 320. While a cylindrical tungsten carbide "blank" may be used as the substrate 320, which is sufficiently long to act as a mounting stud for the cutting face 322, the substrate 320 may equally comprise an intermediate layer bonded at another interface to another metallic mounting stud. To form the cutting face 322, the substrate 320 may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate 320. When using polycrystalline diamond as the ultra-hard material, fixed cutter 312 may be referred to as a polycrystalline diamond compact cutter or a "PDC cutter," and drill bits made using such PDC fixed cutters are generally known as PDC bits.

As illustrated, drill bit 102 may further include a plurality of rolling element assemblies 314 each including a rolling element 316 disposed in housing 318. Housing 318 may be received in a housing pocket sized and shaped to receive housing 318. Without limitation, rolling element 316 may include a generally cylindrical body strategically positioned in a predetermined position and orientation on bit body 300 so that rolling element 316 is able to engage the formation during drilling. It should be noted that rolling element 316 may also be a ball bearing, cylindrical, needle, tapered, and/or circular in shape. The orientation of a rotational axis of each rolling element 316 with respect to a direction of rotation of a corresponding blade 302 may dictate whether any identified rolling element 316 operates purely as a rolling DOCC element, purely a rolling cutting element, or a hybrid of both. The terms "rolling element" and "rolling DOCC element" are used herein to describe the rolling element 316 in any orientation, whether it acts purely as a DOCC element, purely as cutting element, or as a hybrid of both. Rolling elements 316 may prove advantageous in allowing for additional weight-on-bit (WOB) to enhance directional drilling applications without over engagement of fixed cutters 312, and to minimize the amount of torque required for drilling. Effective DOCC also limits fluctuations in torque and minimizes stick-slip, which may cause damage to fixed cutters 312. An optimized three-dimensional position and three-dimensional orientation of rolling element 316 may be selected to extend the life of the rolling element assemblies 314, and thereby improve the efficiency of drill bit 102 over its operational life. As described herein, the three-dimensional position and orientation may be expressed in terms of a Cartesian coordinate system with the Y-axis positioned along longitudinal axis 306, and a polar coordinate system with a polar axis positioned along longitudinal axis 306. Without limitation, drill bit 102 may include a strain gauge 136, further discussed below.

Referring back to FIG. 1, the rotation of drill bit 102 may be controlled by mud motor 116. In examples, mud motor 116 may allow for directionally steering within borehole 118 and may deliver additional energy to drill bit 102 to improve drilling performance. Mud motor 116 may deliver additional power to drill bit 102 by converting fluid energy from the drilling fluid 128, to mechanical rotation of a drill bit shaft in at least a portion of mud motor 116. The conversion of fluid energy to mechanical rotation may be performed by an elastomeric stator within which a metallic stator rotates as fluid is pumped through it. The speed with which the mud motor 116 rotates drill bit 102 is a function of the mud flow rate and the design or configuration of a particular stator and rotor within a mud motor power section. Likewise, the torque applied to drill bit 102 is a function of the differential pressure across the mud motor power section and the design of mud motor 116.

Figure 4:
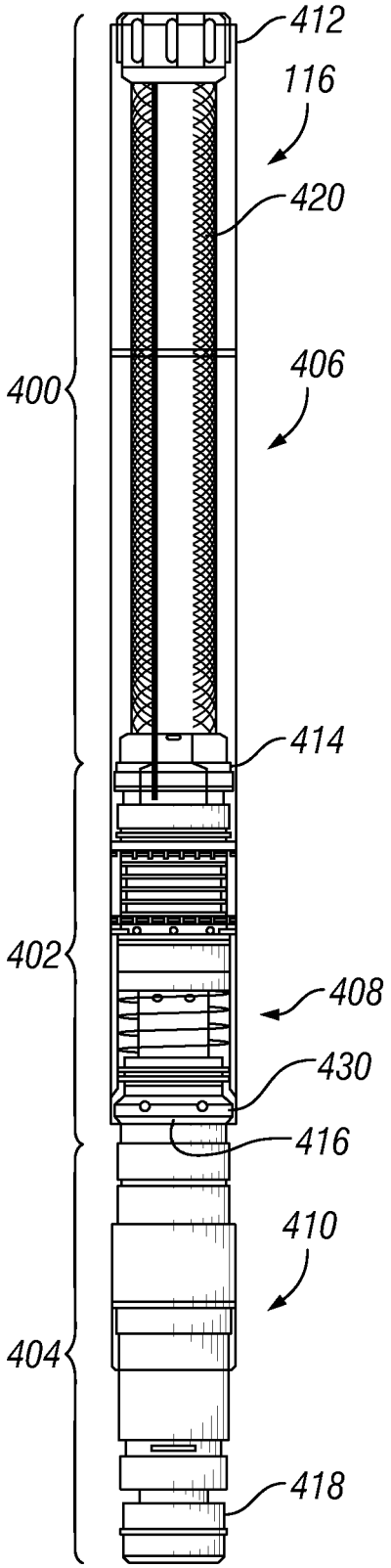
FIG. 4 illustrates an example of a mud motor.

FIG. 4 illustrates an example mud motor 116, which may include a power assembly 400 (e.g., the mud motor power section), a drive assembly 402, and a bearing assembly 404. Each of the assemblies 400, 402, 404 may comprise separate housings 406, 408, and 410, respectively, that are coupled together, such as through threaded connections. In examples, the housing 406 may be coupled directly or indirectly to a drill string 110 (e.g., referring to FIG. 1) at an interface 412, housing 406 may be coupled to housing 408 at interface 414, housing 408 may be coupled to housing 410 at a movable joint 416, and housing 410 may be coupled to a drill bit 102 (e.g., referring to FIG. 1) via a bit shaft 418 at least partially within housing 410. Moveable joint 416 may include a constant-velocity (CV) joint assembly 430 that is described below. Housings 406 and 408 may share a substantially similar rotational position and longitudinal axis as the drill string to which they are coupled. Housing 410 of the bearing assembly 404, in contrast, may have a substantially similar rotational position as the housings 406 and 408 but a different longitudinal axis. Without limitation, some, or all of the assemblies 400, 402, 404 and housings 406, 408, 410 may be integrated.

In examples, power assembly 400 may comprise a rotor 420 that rotates and generates torque in response to a drilling fluid flowing through it. As described below, this rotation and torque may be transmitted to a drive shaft at least partially disposed within drive assembly 402. Drive assembly 402 may receive the torque and rotation from rotor 420 and transmit the torque and rotation to bearing assembly 404. Without limitation, drive assembly 402 may include one or more elements that alter a longitudinal axis of bearing assembly 404. Drive assembly 402 further may comprise the CV joint assembly 430 that connects drive assembly 402 to bearing assembly 404. Bearing assembly 404 may comprise the bit shaft 418 that is driven by the drive shaft within the drive assembly 402. Bit shaft 418 may rotate within housing 410, while housing 410 remains substantially rotationally stable with respect to the housings 408 and 406. A drill bit 102 (e.g., referring to FIG. 1) coupled to bit shaft 418 may be rotated at substantially the same speed as bit shaft 418.

Referring back to FIG. 1, drilling system 100 may further include a mud pump 122, one or more solids control systems 124, and a retention pit 126. Mud pump 122 representatively may include any conduits, pipelines, trucks, tubulars, and/or pipes used to fluidically convey drilling fluid 128 downhole, any pumps, compressors, or motors (e.g., topside or downhole) used to drive the drilling fluid 128 into motion, any valves or related joints used to regulate the pressure or flow rate of drilling fluid 128, any sensors (e.g., pressure, temperature, flow rate, etc.), gauges, and/or combinations thereof, and the like.

Mud pump 122 may circulate drilling fluid 128 through a feed conduit 130 and to kelly 112, which may convey drilling fluid 128 downhole through the interior of drill string 110 and through one or more orifices (not shown) in drill bit 102. Drilling fluid 128 may then be circulated back to surface 134 via a borehole annulus 160 defined between drill string 110 and the walls of borehole 118. At surface 134, the recirculated or spent drilling fluid 128 may exit borehole annulus 160 and may be conveyed to one or more solids control system 124 via an interconnecting flow line 132. One or more solids control systems 124 may include, but are not limited to, one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, and/or any fluid reclamation equipment. The one or more solids control systems 124 may further include one or more sensors, gauges, pumps, compressors, and the like used to store, monitor, regulate, and/or recondition the drilling fluid 128.

After passing through the one or more solids control systems 124, drilling fluid 128 may be deposited into a retention pit 126 (e.g., a mud pit). While illustrated as being arranged at the outlet of borehole 118 via borehole annulus 160, the one or more solids controls system 124 may be arranged at any other location in drilling system 100 to facilitate its proper function, without departing from the scope of the disclosure. While FIG. 1 shows only a single retention pit 126, there could be more than one retention pit 126, such as multiple retention pits 126 in series. Moreover, retention pit 126 may be representative of one or more fluid storage facilities and/or units where the drilling fluid additives may be stored, reconditioned, and/or regulated until added to drilling fluid 128.

Drilling system 100 may further include information handling system 140 configured for processing the measurements from sensors (where present), such as strain gauge 136, discussed below, disposed on drill bit 102. Measurements taken may be transmitted to information handling system 140 by communication module 138. As illustrated, information handling system 140 may be disposed at surface 134. In examples, information handling system 140 may be disposed downhole. Any suitable technique may be used for transmitting signals from communication module 138 to information handling system 140. A communication link 150 (which may be wired, wireless, or combinations thereof, for example) may be provided that may transmit data from communication module 138 to information handling system 140. Without limitation, information handling system 140 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, information handling system 140 may be a personal computer, a network storage device, or any other suitable device and may vary in size, shape, performance, functionality, and price. Information handling system 140 may include random access memory (RAM), one or more processing resources (e.g. a microprocessor) such as a central processing unit 142 (CPU) or hardware or software control logic, ROM, and/or other types of nonvolatile memory. Additional components of information handling system 140 may include one or more monitors 144, an input device 146 (e.g., keyboard, mouse, etc.) as well as computer media 148 (e.g., optical disks, magnetic disks) that may store code representative of the methods described herein. Information handling system 140 may also include one or more buses (not shown) operable to transmit communications between the various hardware components.

In examples, information handling system 140 may be utilized to improve mud motor 116 construction while mud motor 116 may be utilized during drilling operations. For example, currently mud motor manufacturers commonly publish reference charts which plot the nominal speed and torque output of mud motor 116 with different combinations of flow rate and differential pressure. In practice, these nominal values vary due to mud properties, temperature, dimensional fit (e.g., clearance or interference) between the rotor and stator and the physical condition of mud motor 116. Before utilizing mud motor 116 during drilling operations, mud motor 116 may be placed in a surface dynamometer where a working fluid, usually water, is pumped through the motor and the output (e.g., torque and shaft speed) of the motor is measured, and compared against the nominal power curve provided by the manufacturer. Such tests are also performed as a proof test to screen out mud motors 116 which may have infantile failures in the wellbore due to an assembly defect. However, in practice, surface dynamometers are rarely used. Currently, dynamometers may not be used due to the additional time and expense required to perform the test, availability of dynamometers, inability to replicate downhole conditions (i.e., downhole pressure and temperature), and inability to replicate drilling fluid properties.

Figure 5:
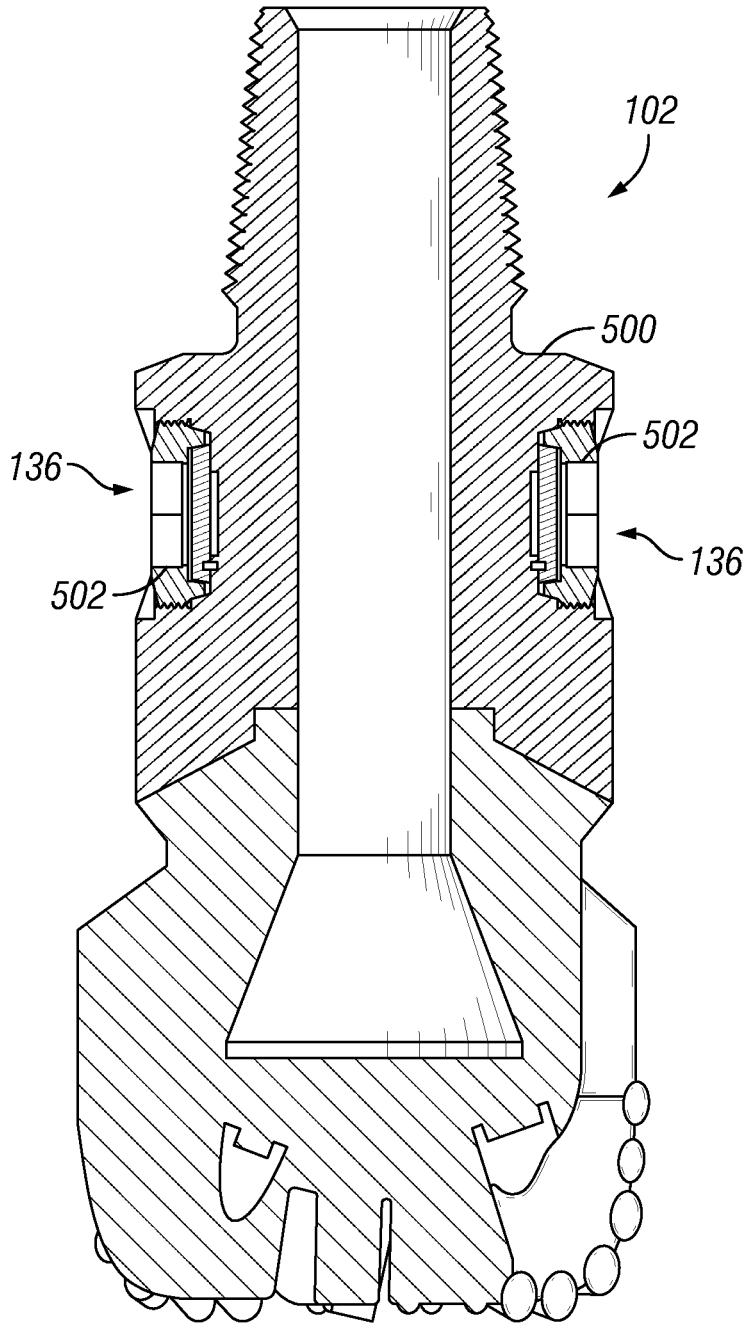
FIG. 5 illustrates a cross section view of the drill bit and location of a strain gauge.
Figure 9:
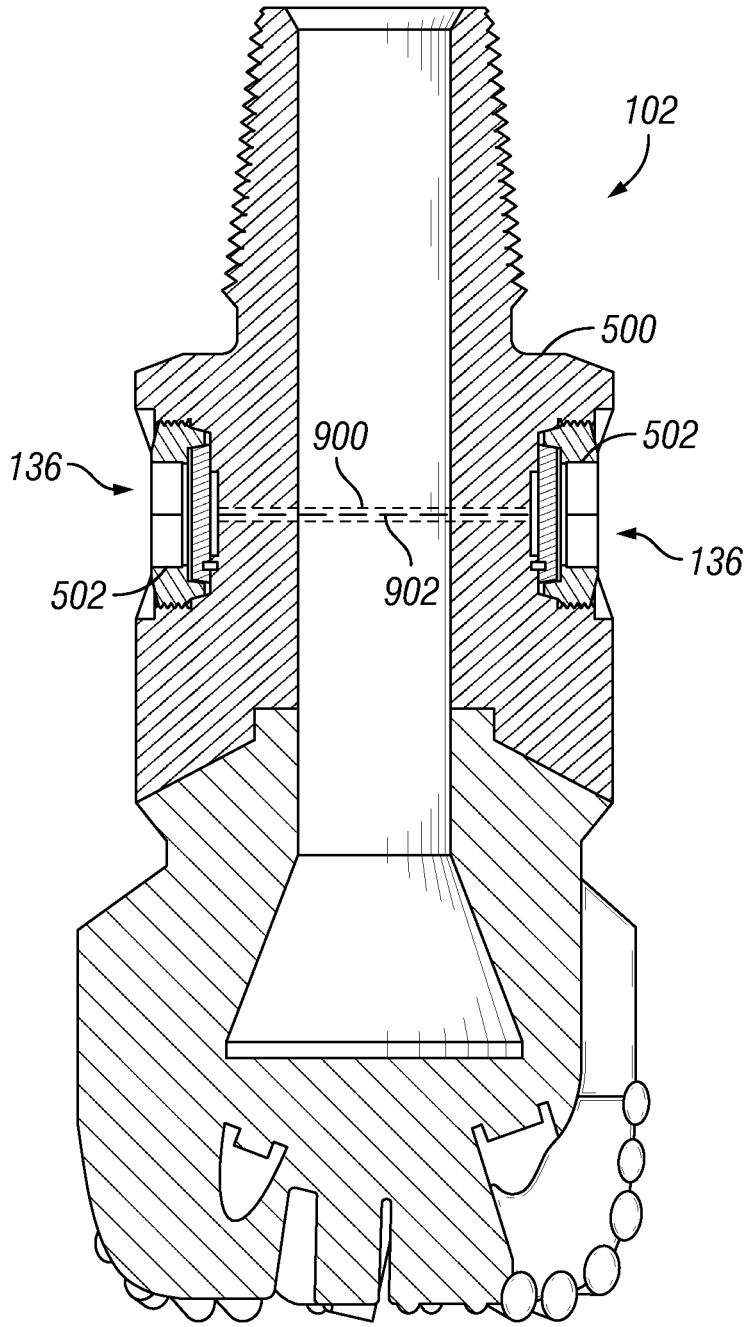
FIG. 9 illustrates two or more strain gauges connected together.

FIG. 5 illustrates a cross sectional view of a removable strain gauge 136 disposed in a drill bit 102. In other examples, strain gauge 136 may be non-removable. As illustrated in FIG. 5, there are two strain gauge 136 is disposed in a shank 500 of drill bit 102. However, there may be any number of strain gauges 136 disposed in shank 500. As illustrated, two strain gauges may be puck like in design. Each strain gauge 136 is disposed approximately 180 degrees from one another within recessed areas 502. In examples, strain gauge 136 may be held in recessed areas 502 through threading, compression, and/or the like. In one example, one or more strain gauges 136 may be disposed within one or more junk slots and/or fluid flow paths of drill bit 102. For example, one or more strain gauges 136 may be positioned such that downhole forces applied to junk slots and/or fluid flow paths may be similarly applied to strain gauges 136 and, in turn, to the strain gauges disposed thereon. In another example, the strain gauges 136, disposed in the shank 500 of the drill bit 102 approximately 180 degrees from one another and within the recessed area 502, may be interconnected (e.g., referring to FIG. 9). The shank 500 may include a bore 900 extending through the shank 500 between the strain gauges 136. The strain gauges 136 may be interconnected via a hardwire connection 902 extending between the strain gauges 136 and through the bore 900. Interconnecting the strain gauges 136 may allow for improved packaging of the strain gauges 136 with various downhole components (e.g., accelerometers, magnetometers, processors, batteries, etc.). Further, regarding positioning of the strain gauges 136, interconnecting the strain gauges 136 may allow the strain gauges 136 to be spread further apart than non-interconnected strain gauges, which may improve measurement resolution. In another example, one or more strain gauges 136 may be disposed on one or more blades of drill bit 102 such that downhole forces applied to each of the one or more blades may be similarly applied to strain gauges 136 and to the strain gauges disposed thereon. In each of the examples described above, strain gauges 136 may include transmitters used to transmit data indicating downhole forces to one or more receivers such that the data from each strain gauge may be analyzed.

Referring back to FIG. 5, each strain gauge 136 may collect data indicating downhole forces applied to drill bit 102 during a drilling operation. In particular, downhole forces applied to shank 500 of drill bit 102 may be similarly applied to each strain gauge 136. In examples, strain gauge 136 may transmit data indicating downhole forces to one or more receivers such that the data from each strain gauge 136 may be analyzed. Specifically, strain gauge 136 may collect data indicating compression forces, bending forces, and torsional forces applied to each strain gauge 136 during a drilling operation and may transmit the collected data in real-time. This data may be received by a receiver for real-time analysis or stored in a memory medium within drill bit 102 for analysis at a later time.

Analysis of data received from strain gauge 136 by information handling system 140 (e.g., referring to FIG. 1) may suggest ways in which one or more downhole drilling parameters may be modified to reduce the magnitude of the downhole forces applied to drill bit 102. Examples of the downhole drilling parameters may include rotational speed of drill bit 102 in revolutions per minute (RPM), a rate of penetration (ROP), a weight on bit (WOB), a torque on bit (TOB), and a depth-of-cut control (DOCC). The rate of penetration (ROP) of drill bit 102 may be a function of both weight on bit (WOB) and revolutions per minute (RPM). Referring back to FIG. 1, drill string 110 may apply weight on drill bit 102 and may also rotate drill bit 102 about a rotational axis to form borehole 118. The depth-of-cut per revolution may also be based on ROP and RPM of a particular bit and indicates how deeply the cutting elements (e.g., referring to FIGS. 2 and 3) may be engaging the formation. An analysis of the data received from strain gauge 136 may indicate which of the downhole drilling parameters may be causing or contributing to compression forces, bending forces, and/or torsional forces applied to strain gauge 136 during drilling operations.

Referring back to FIG. 5, strain gauges 136 may be disposed approximately 180 degrees from one another, data received from strain gauges disposed on each strain gauge 136 may be used simultaneously for analysis to determine downhole forces being applied to both sides of shank 500 (e.g., compression or bending). In examples, data indicating compression forces applied to both strain gauge 136 may be analyzed to calculate the weight on bit (WOB) based on a compression value from either strain gauge 136 and a compression value from the other strain gauge 136. In other examples, a bending value may be calculated based on a compression value from one strain gauge 136 and a tension value (i.e., indicating a tensile force) from the other strain gauge 136. In yet another examples, a torque on bit (TOB) value may be calculated based on torsion value (i.e., indicating a torsional force) applied to both strain gauges 136. In another example, drill bit 102 may include three strain gauge 136 disposed 120 degrees from one another. In yet another example, drill bit 102 may include four strain gauges 136 disposed 90 degrees from one another.

In each of these examples, data received from strain gauge 136 may be used simultaneously for analysis to determine downhole forces being applied to shank 500, for example, to identify a direction of a bending force and/or to determine whether a torsional force is symmetric around shank 500.

Values indicating WOB, bending, and TOB may be used to determine a set of optimized downhole drilling parameters in order to extend the lifetime of the downhole drilling tool and/or perform more efficient drilling operations. In particular, if WOB exceeds an adjustable threshold, compression forces applied to the downhole drilling tool may damage the downhole drilling tool or result in inefficient drilling operations. Accordingly, WOB may be modified such that WOB is within the adjustable threshold. Similarly, if a bending value exceeds an adjustable threshold, bending forces may damage the downhole drilling tool or drill string 110 (e.g., referring to FIG. 1) of drilling system 100 (e.g., referring to FIG. 1). In response, the bending value may be modified such that the bending value is within the adjustable threshold, thereby reducing the bending forces applied to the downhole drilling tool. Lastly, if TOB exceeds an adjustable threshold, the TOB may be modified such that the TOB value is within the adjustable threshold, thereby reducing torsional forces applied to the downhole drilling tool. Additionally, if WOB, bending, and TOB values are determined to be within only a fraction (e.g., 25 percent) of each corresponding adjustable threshold, downhole drilling parameters may be modified to increase compression forces (i.e., WOB), bending forces, and torsional forces (i.e., TOB) such that the modified downhole drilling parameters may result in more efficient drilling operations.

As discussed above, strain gauge 136 may take downhole measurements of forces applied to drill bit 102. In additional examples, downhole measurements of one or more parameters of mud motor 116 may be taken by sensors disposed on an instrument sub disposed on drill string 110. These parameters may be weight on bit, torque on bit, inner pressure, outer pressure, rotational speed, and/or the like. In examples, parameters that may be measured may be transmitted to the information handling system 140 to be processed with surface characteristics that are taken at drilling platform 104. Without limitation, surface data may be pipe rotation rate, flow rate, differential pressure, and/or the like. The information handling system 140 may receive the surface data from sensors disposed proximate the drilling platform 104 (e.g., referring to FIG. 1) or from another source. Utilizing parameters measured downhole and surface data, information handling system 140 may replicate the function of a dynameter during real downhole drilling conditions to determine one or more characteristics of mud motor 116.

Figure 6:
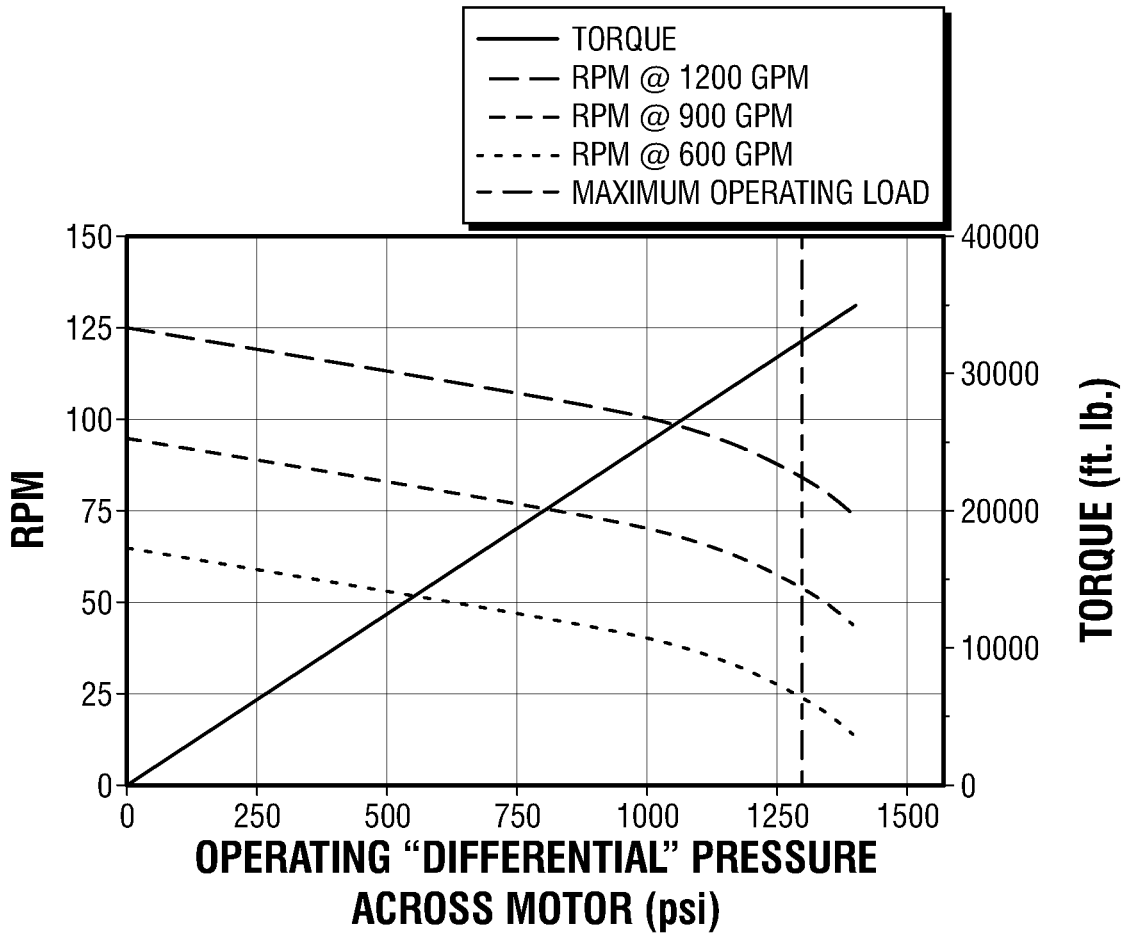
FIGS. 6-8 are graphs of simulated data illustrated motor performance in different environments.
Figure 7:
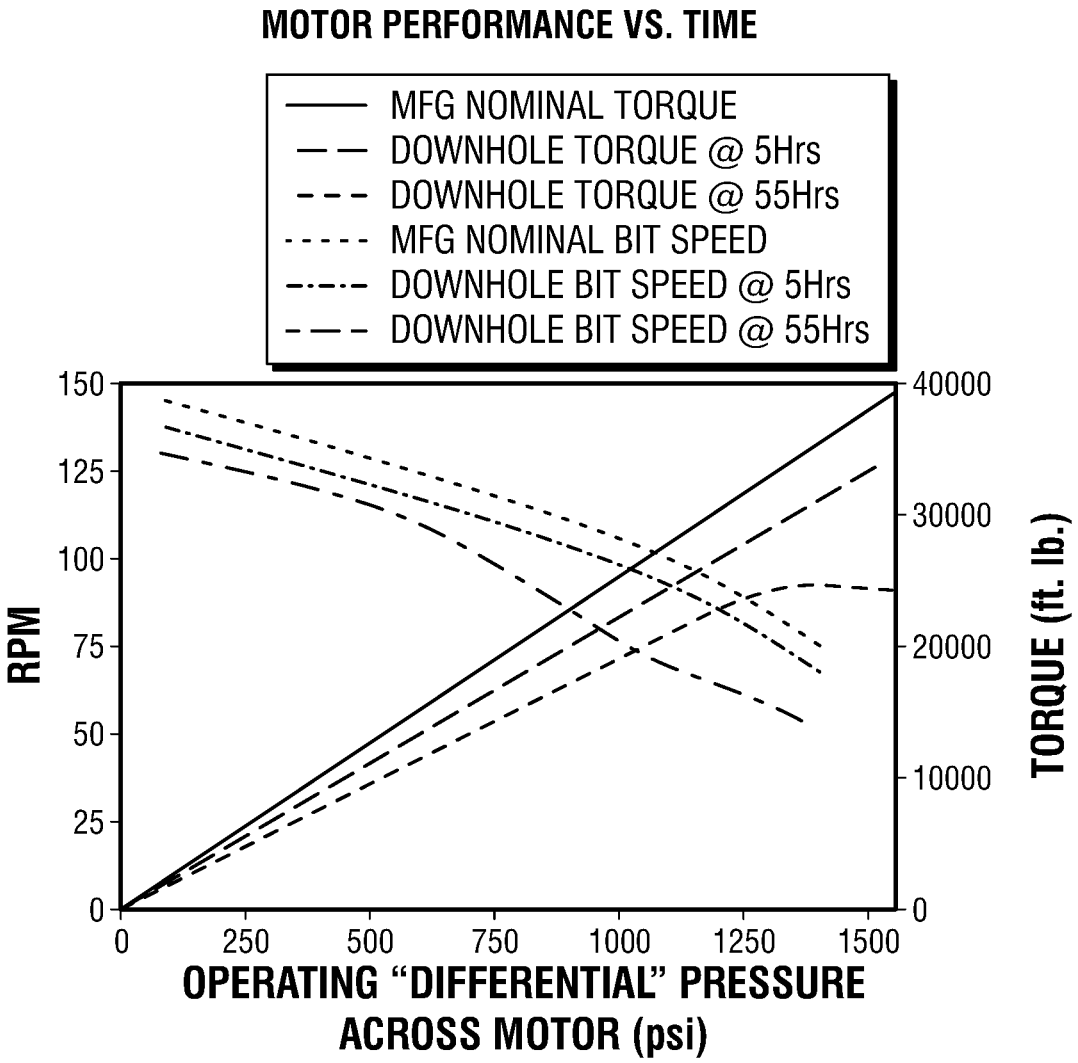
Figure 8:
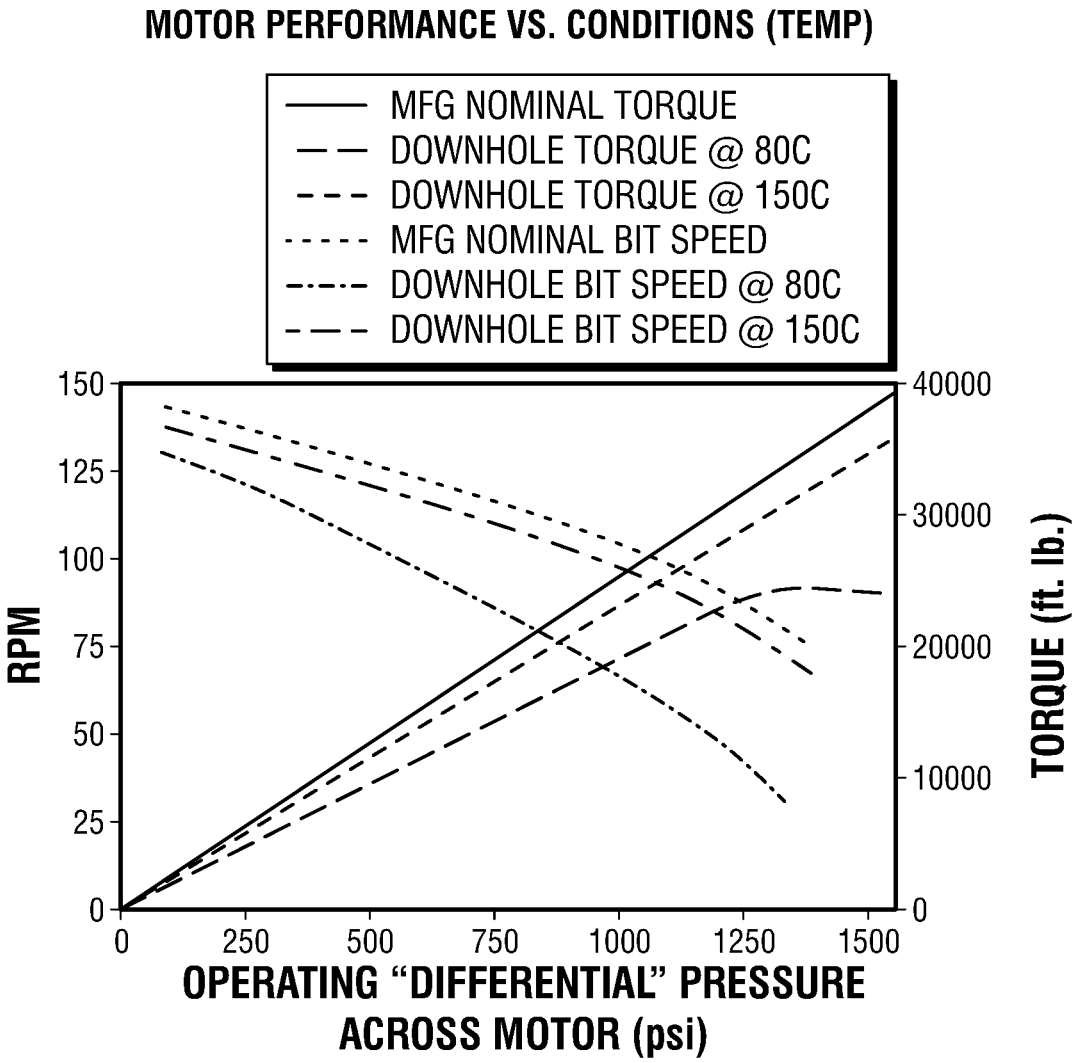

Measurements may be processed by information handling system 140 to determine mud motor 116 performance. For example, FIG. 6 is a graph of simulated data illustrating mud motor 116 characteristics that may be provided by a manufacturer. Simulated data from measurements taken downhole and at the surface illustrate mud motor 116 performance over time in FIG. 7 and FIG. 8 illustrates mud motor 116 performance over downhole conditions, such as temperature. Measurements taken downhole, at the surface, and recorded in graphs may be utilized to determine a rotational rate of a mud motor power section with the following equation:

$$N_{Motor}=N_{Bit}-N_{Surf} \quad (1)$$

the variables are defined as $N_{Surf}$=rotary speed of drilling rig measured at the top drive or rotary table, $N_{Bit}$=rotation rate measured at the drill bit, and $N_{Motor}$=rotation rate of mud motor power section. The measurements may be used to calculate differential pressure across mud motor 116 as:

$$P_{Diff}=P_{Drilling}-P_{Offbottom} \quad (2)$$

the variables are defined as $P_{Drilling}$=drilling rig standpipe pressure as measured while drilling on bottom, $P_{Offbottom}$=drilling rig standpipe pressure as measured while circulation off bottom, and $P_{Diff}$=calculated differential pressure across motor power section. Additionally, measurements may be used to find rotary torque input from surface delivered to the top of mud motor 116 and the rotary torque output of mud motor 116 with the equations below:

$$T_{BHA}=T_{Surf}-T_{Drag} \quad (3)$$

$$T_{Motor}=T_{Bit}-T_{BHA} \quad (4)$$

the variable are defined as $T_{Bit}$=torque measured at the drill bit, $T_{Surf}$=torque delivered from the top drive or rotary table, $T_{Drag}$=torque lost from borehole wall friction, $T_{BHA}$=rotary torque from surface delivered to the top of the mud motor, and $T_{Motor}$=rotary torque output of motor power section. Determining these variables and solving Equations (1)-(4) may be sent to mud motor manufactures to adjust the current mud motor 116 or develop new mud motors for future drilling operations. That is, the mud motor may be adjusted based at least in part on the one or more parameters of the mud motor and the surface data. For example, the adjustment to the mud motor may be an adjustment to the design or configuration of a particular stator and rotor of the mud motor. In particular, the stator and rotor may be adjusted to decrease the RPM and increase torque. Alternatively, the stator and rotor may be adjusted to increase the RPM and decrease torque based at least in part on the one or more parameters of the mud motor and the surface data.

Referring back to FIG. 1, mud motor 116 may be utilized with different devices downhole or at the surface to perform different operations. For example, mud motor 116 may be utilized with a bottom hole assembly 152 in concert with a rotary steerable system 154. In another example, a drilling turbine may be utilized in place of mud motor 116. As discussed above, measurements may be communicated to the surface 134 by communication module 138. Communication may be telemetered to the surface 134 utilizing mud pulse, electromagnetic, fiber optic or electrical telemetry. Using the equations set forth above, the telemetered data may be merged with the surface data at the surface 134 in real time to provide feedback to personnel operating the drilling rig, or utilized as an input into a computer controlled rig control system.

In examples, a flow rate may be calculated downhole by adding bore and annulus pressure measurements in drill bit 102 and knowing fluid density. By using Bernoulli's principle, a flow rate may be determined without surface input. As discussed above, an instrument sub may be utilized in conjunction with mud motor 116. In examples, a sub pressure transducer may be disposed on instrument sub with on/off bottom differential pressure, and pressure drop across the mud motor 116 may also be measured to improve characterization of motor performance. By using a sub, rotary speed may also be directly measured above the mud motor 116 in place of surface rotary speed measurements Improvements over current technology is the determination of mud motor parameters downhole which may be based at least in part on pressure and/or temperature found downhole and not in a dynamometer. Thus, the measurements may be a source of input into the mud motor design process, optimize mud motor configurations including selected fit and elastomer, optimize drilling parameters to improve performance and reduce failures, and/or characterize the performance of the mud motor over time. Observing the mud motor over time may show effects of wear on the motor power section and/or transmission and bearing section and its effect on the output of the motor.

The systems and methods for identifying properties of a formation from motion measurements of a drill bit may include any of the various features of the systems and methods disclosed herein, including one or more of the following statements.

Statement 1. A method for using a mud motor may comprise drilling a borehole into a formation using a drill string connected to the mud motor and the mud motor is connected to a drill bit; measuring one or more parameters of the mud motor in the borehole; sending the one or more parameters of the mud motor to surface; and merging the one or more parameters of the mud motor and surface data to identify one or more characteristics of the mud motor.

Statement 2. The method of statement 1, wherein the measuring the one or more parameters of the mud motor is performed by a strain gauge.

Statement 3. The method of statement 2, wherein the one or more parameters of the mud motor comprise at least one parameter selected from the group consisting of weight on bit, torque on bit, inner pressure, outer pressure, or rotational speed.

Statement 4. The method of statement 3, wherein the strain gauge is disposed on a shank of the drill bit.

Statement 5. The method of statement 1, wherein the mud motor includes a power assembly, a drive assembly, and a bearing assembly.

Statement 6. The method of statement 1, wherein the surface data is pipe rotation rate, flow rate, or differential pressure.

Statement 7. The method of statement 1, further comprising identifying a rotational rate of the mud motor by subtracting a rotational speed of a drilling rig measured at surface from a rotational speed of the drill bit measured at the drill bit.

Statement 8. The method of statement 1, further comprising identifying a differential pressure across the mud motor by subtracting a drilling rig standpipe pressure as measured while circulation off bottom from the drilling rig standpipe pressure as measured while drilling on bottom.

Statement 9. The method of statement 1, further comprising identifying a rotary torque input to the mud motor by subtracting a torque lost via borehole wall friction from torque delivered from surface.

Statement 10. The method of statement 1, further comprising identifying a rotary torque output of the mud motor by subtracting a rotary torque input to the mud motor from a torque measured at the drill bit.

Statement 11. The method of statement 1, further comprising adjusting the mud motor based at least in part on the one or more parameters of the mud motor and the surface data.

Statement 12. A system may comprise a mud motor connected to a drill string; a drill bit connected to the mud motor; a strain gauge connected to the drill bit and configured to take one or more parameters of the mud motor; and an information handling system in communication with the strain gauge and configured to: record the one or more parameters from the strain gauge.

Statement 13. The system of statement 12, wherein the information handling system is further configured to record surface data.

Statement 14. The system of statement 13, wherein the one or more parameters of the mud motor comprise at least one parameter selected from the group consisting of weight on bit, torque on bit, inner pressure, outer pressure, or rotational speed.

Statement 15. The system of statement 14, wherein the surface data is pipe rotation rate, flow rate, or differential pressure.

Statement 16. The system of statement 12, wherein the information handling system further identifies a rotational rate of the mud motor by subtracting a rotational speed of a drilling rig measured at surface from a rotational speed of the drill bit measured at the drill bit.

Statement 17. The system of statement 12, wherein the information handling system further identifies a differential pressure across the mud motor by subtracting a drilling rig standpipe pressure as measured while circulation off bottom from the drilling rig standpipe pressure as measured while drilling on bottom.

Statement 18. The system of statement 12, wherein the information handling system further identifies a rotary torque input to the mud motor by subtracting a torque lost via borehole wall friction from torque delivered from surface.

Statement 19. The system of statement 12, wherein the information handling system further identifies a rotary torque output of the mud motor subtracting a rotary torque input to the mud motor from a torque measured at the drill bit.

Statement 20. The system of statement 12, wherein the information handling system is further configured to adjust the mud motor based at least in part on the one or more parameters of the mud motor and surface data.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited. Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for using a mud motor, comprising:

drilling a borehole into a formation using a drill string connected to the mud motor, wherein the mud motor is connected to a drill bit, wherein the drill bit comprises a plurality of recesses formed in an outer surface of the drill bit, wherein the plurality of recesses comprises at least a first recess and a second recess, and wherein the drill bit comprises at least one bore that extends through the drill bit between the first recess and the second recess;

measuring one or more parameters of the mud motor in the borehole, wherein the one or more parameters of the mud motor comprise at least a torque measured at the drill bit via a plurality of strain gauges, wherein the plurality of strain gauges comprises at least a first strain gauge and a second strain gauge secured within the first and second recesses, respectively, and wherein the first strain gauge and the second strain gauge are interconnected via a hardwire connection extending through the at least one bore;

sending the one or more parameters of the mud motor to surface; and merging the one or more parameters of the mud motor and surface data to identify one or more characteristics of the mud motor, wherein the one or more characteristics of the mud motor at least comprise a rotary torque output of the mud motor, and wherein the rotary torque output of the mud motor is identified by subtracting a rotary torque input from a surface rotary device to the mud motor from the torque measured at the drill bit.

2. The method of claim 1, wherein the one or more parameters of the mud motor comprise at least one parameter selected from the group consisting of weight on bit, inner pressure, outer pressure, and rotational speed.

3. The method of claim 1, wherein the strain gauges of the plurality of strain gauges are disposed on a shank of the drill bit, a junk slot of the drill bit, a blade of the drill bit, or some combination thereof.

4. The method of claim 1, wherein the surface data is pipe rotation rate, flow rate, or differential pressure.

5. The method of claim 1, further comprising identifying a rotational rate of the mud motor by subtracting a rotational speed of a rotary drive measured at surface from the rotational speed of the drill bit measured at the drill bit.

6. The method of claim 1, further comprising identifying a differential pressure across the mud motor by subtracting a drilling rig standpipe pressure as measured while circulating off bottom from the drilling rig standpipe pressure as measured while drilling on bottom.

7. The method of claim 1, further comprising identifying a rotary torque input to the mud motor by subtracting a torque lost via borehole wall friction from torque delivered from surface.

8. The method of claim 1, further comprising adjusting the mud motor based at least in part on the one or more parameters of the mud motor and the surface data, and wherein the one or more parameters of the mud motor are sent to surface in real-time.

9. A system comprising:

a mud motor connected to a drill string;

a drill bit connected to the mud motor;

a plurality of recesses formed in the drill bit, wherein the plurality of recesses comprises at least a first recess and a second recess;

at least one bore formed in the drill bit, wherein the at least one bore extends through the drill bit between the first recess and the second recess;

a plurality of strain gauges configured to measure one or more parameters of the mud motor, wherein the one or more parameters of the mud motor comprise at least a torque measured at the drill bit via the plurality of strain gauges, wherein the plurality of strain gauges comprises a least a first strain gauge and a second strain gauge secured within the first and second recesses, respectively; and an information handling system in communication with the at least one strain gauge and configured to record the one or more parameters from the at least one strain gauge, and wherein the information handling system is configured to merge the one or more parameters of the mud motor and surface data to identify one or more characteristics of the mud motor, wherein the one or more characteristics of the mud motor at least comprise a rotary torque output of the mud motor, and wherein the rotary torque output of the mud motor is identified by subtracting a rotary torque input from a surface rotary device to the mud motor from the torque measured at the drill bit.

10. The system of claim 9, wherein the information handling system is further configured to record surface data.

11. The system of claim 10, wherein the one or more parameters of the mud motor further comprises at least one parameter selected from the group consisting of weight on bit, torque on bit, inner pressure, outer pressure, or rotational speed.

12. The system of claim 9, wherein the surface data is pipe rotation rate, flow rate, or differential pressure.

13. The system of claim 9, wherein the information handling system further identifies a rotational rate of the mud motor by subtracting a rotational speed of a rotary table measured at surface from a rotational speed of the drill bit measured at the drill bit.

14. The system of claim 9, wherein the information handling system further identifies a differential pressure across the mud motor by subtracting a drilling rig standpipe pressure as measured while circulating off bottom from the drilling rig standpipe pressure as measured while drilling on bottom.

15. The system of claim 9, wherein the information handling system further identifies a rotary torque input to the mud motor by subtracting a torque lost via borehole wall friction from torque delivered from surface.

16. The system of claim 9, wherein the information handling system is further configured to adjust the mud motor based at least in part on the one or more parameters of the mud motor and surface data.

17. The system of claim 9, wherein the recesses of the plurality of recesses are formed in a shank of the drill bit, a junk slot of the drill bit, a blade of the drill bit, or some combination thereof.

18. The system of claim 9, wherein each strain gauge of the plurality of strain gauges threaded into a corresponding recess of the plurality of recesses to secure the plurality of strain gauges within the plurality of recesses.

19. The system of claim 9, wherein the first strain gauge and the second strain gauge are disposed one-hundred and eighty degrees apart from each other about the drill bit.

20. The system of claim 9, wherein the plurality of strain gauges further comprises a third strain gauge, wherein the first strain gauge, the second strain gauge, and the third strain gauge are disposed one-hundred and twenty degrees apart from each other about the drill bit.

21. The system of claim 9, wherein the strain gauges of the plurality of strain gauges are axially aligned with respect to the drill bit.

22. The system of claim 9, wherein the first strain gauge and the second strain gauge are interconnected via hardwire connection extending through the at least one bore.

* * * * *